US006967014B1

(12) United States Patent
Olry et al.

(10) Patent No.: US 6,967,014 B1
(45) Date of Patent: Nov. 22, 2005

(54) METHOD OF OBTAINING A CARBON FIBER FABRIC BY CONTINUOUSLY CARBONIZING A CELLULOSE FIBER FABRIC

(75) Inventors: Pierre Olry, Bordeaux (FR); Mark Kazakov, Moscow (RU); Sylvie Loison, Saint Medard en Jalles (FR); Marina Marakhovskaya, Moscow (RU)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 09/890,695

(22) PCT Filed: Dec. 5, 2000

(86) PCT No.: PCT/FR00/03385

§ 371 (c)(1),
(2), (4) Date: Aug. 3, 2001

(87) PCT Pub. No.: WO01/42543

PCT Pub. Date: Jun. 14, 2001

(30) Foreign Application Priority Data

Dec. 6, 1999 (FR) ..... 99 15330

(51) Int. Cl.[7] ..... D01F 9/16
(52) U.S. Cl. ..... 423/447.9; 423/447.8; 423/447.1; 423/447.6; 264/29.4

(58) Field of Search ..... 423/447.9, 447.8, 423/447.1, 447.6; 264/29.4, 29.1; 428/311.71

(56) References Cited

U.S. PATENT DOCUMENTS

| | | | | |
|---|---|---|---|---|
| 3,053,775 | A * | 9/1962 | Abbott | 502/420 |
| 3,461,082 | A * | 8/1969 | Yoshihiko et al. | 502/432 |
| 3,692,577 | A | 9/1972 | Evans | |
| 4,073,870 | A * | 2/1978 | Saji et al. | 423/447.6 |
| 4,274,979 | A * | 6/1981 | Simpson | 502/420 |
| 4,409,125 | A * | 10/1983 | Nishino et al. | 502/180 |
| 4,543,241 | A * | 9/1985 | Yoshinari et al. | 423/447.7 |

FOREIGN PATENT DOCUMENTS

| | | |
|---|---|---|
| GB | 1 136 349 | 12/1968 |
| GB | 1 301 101 | 12/1972 |

* cited by examiner

*Primary Examiner*—Stanley S. Silverman
*Assistant Examiner*—Peter J. Lish
(74) *Attorney, Agent, or Firm*—Weingarten, Schurgin, Gagnebin & Lebovici LLP

(57) ABSTRACT

The carbonization of cellulose fiber fabric comprises an initial stage of heat treatment up to 250° C. to 350° C., with a relatively high mean temperature rise speed of 10° C./min to 60° C./min, an intermediate stage up to 350° C. to 500° C. with a lower mean temperature rise speed of 2° C./min to 10° C./min, and a final stage up to 500° C. to 750° C. with a mean temperature rise speed that is again raised to 5° C./min to 40° C./min.

9 Claims, 3 Drawing Sheets

METHOD OF OBTAINING A CARBON FIBER FABRIC BY CONTINUOUSLY CARBONIZING A CELLULOSE FIBER FABRIC

FIELD OF THE INVENTION

The invention relates to manufacturing carbon fiber fabrics from fabric made of fibers of a cellulose material that is a precursor of carbon.

More particularly, but not exclusively, the invention relates to manufacturing carbon fiber fabrics by carbonizing a fabric made of viscose fibers, in particular rayon fibers.

BACKGROUND OF THE INVENTION

Cellulose-precursor carbon fibers generally present a porous structure made up of highly disorganized turbostratic carbon, said structure also being highly disoriented relative to the axial direction of the fibers and their pore lattices.

Those characteristics confer low thermoconductivity on the carbon fibers, thereby making them particularly suitable for forming thermal protection coatings, such as ablative coatings for combustion chambers and thruster nozzles.

Other applications have been envisaged for cellulose-precursor carbon fiber fabric, in particular for making heating resistors, making battery electrodes, or catalyst supports, or forming activated fabric used as absorbent material.

Methods of obtaining fabric made of cellulose-precursor carbon fibers are known. Reference can be made in particular to U.S. Pat. Nos. 3,053,775, 3,107,152, 3,305,315, and 3,663,173.

A commonly used method consists in performing direct carbonization on a cellulose fiber fabric, in particular a viscose fabric. The fabric is put into the form of a hank that is several hundreds of meters (m) long. It is precarbonized up to a temperature of about 400° C. Precarbonization is performed in a container, preferably under an inert atmosphere, e.g. while being swept with nitrogen. The effluents coming from the decomposition of the cellulose are sucked away and burned off in a flare.

Temperature rises very slowly so as to comply with the decomposition kinetics of cellulose, so as to obtain a satisfactory yield of carbon, and so as to ensure that the decomposition reaction, which is exothermic, does not run away, since such a runaway could destroy the mechanical properties of the resulting carbon fibers. By way of example, for a 100 m long hank, precarbonization can last for as much as 15 days, which is extremely long.

The precarbonization stage is followed by heat treatment at a temperature of about 1200° C. for about 1 minute (min) to 2 min. Final treatment at high temperature, e.g. as high as 2800° C., can be performed to increase the conductivity of the carbon and close its pores.

A method and an installation for obtaining carbon fiber fabric by continuously carbonizing a cellulose fiber fabric with heat treatment lasting for a much shorter duration is described in Russian patents Nos. 2 005 829, 2 045 472, and 2 047 674.

The precursor fabric, e.g. of engineering viscose fibers, is impregnated by an organosilicon compound having the effect of conserving good mechanical properties for the resulting carbon fiber fabric. The organosilicon compound is selected from compounds in the group: polydimethylphenylallylsilanes, polysiloxanes, polymethylsiloxanes, polysilazanes, and polyalumunio-organosiloxanes.

The impregnated fabric is subjected to continuous heat treatment in air at a temperature lying in the range 100° C. to 300° C., and more particularly in the range 100° C. to 150° C. so as to relax the stresses which exist in the cellulose fibers and so as to eliminate the water adsorbed by the fibers.

Carbonization is then performed on the fabric passing continuously through an enclosure under an inert atmosphere, with the temperature being raised progressively up to 300° C. to 600° C. High temperature treatment up to a maximum of 2800° C. under an inert atmosphere is then performed.

During carbonization, the gas effluents of cellulose pyrolysis are sucked up and burned off in a flare, with the suction means being located in the enclosure where most cellulose degradation takes place.

That method makes it possible to obtain satisfactory mechanical properties for the carbon fibers, but it leads to the resulting fabric being deformed, e.g. by disorganizing its weave and by warp shrinkage.

Such deformation is not acceptable, in particular when the fabric is to be used for making preforms for composite material parts, since the deformation leads to fibers being distributed in non-uniform manner within the preform, and that affects the behavior of composite material parts reinforced by such fabric.

OBJECT AND SUMMARY OF THE INVENTION

An object of the invention is to avoid those drawbacks by proposing a method of obtaining carbon fiber fabrics by carbonizing cellulose fiber fabrics, in which method a carbon fiber fabric is obtained, that does not present significant deformation.

This object is achieved by a method in which a fabric travelling continuously through a carbonization chamber is subjected to heat treatment comprising:

- an initial stage for bringing the temperature of the fabric to a value lying in the range 250° C. to 350° C., the initial stage comprising temperature rise at a first mean speed lying in the range 10° C./min to 60° C./min;
- an intermediate stage for raising the temperature of the fabric to a value lying in the range 350° C. to 500° C., the intermediate stage comprising temperature rising at a second mean speed lower than the first and lying in the range 2° C./min to 10° C./min; and
- a final stage for raising the temperature of the fabric to a value lying in the range 500° C. to 750° C., the final stage comprising temperature rising at a third mean speed greater than the second and lying in the range 5° C./min to 40° C./min.

The selection of this particular temperature profile during carbonization satisfies the concern to find the best compromise between the quality of carbonization, from which in particular the mechanical behavior of the fibers depends, the quality of the appearance of the fabric, i.e. the absence of significant warp shrinkage and an unaltered warp/weft geometrical configuration, and keeping production costs down to an acceptable level.

During carbonization, a cellulose fiber yarn is subject to significant shrinkage. This can be as much as 30% to 40% when the yarn is not subject to any tension.

For a fabric that is being subjected to a continuous carbonization process, shrinkage of the weft yarn is practically unconstrained and therefore almost reaches the maximum value.

The shrinkage of the weft yarn between the entrance and the exit of the chamber causes the strands of warp yarn to converge (move progressively towards one another). A situation which is favorable to obtaining carbon fiber fabric without excessive warp shrinkage and without deforming its shape would be a solution in which, along the path through the chamber, shrinkage affects both warp yarn and weft yarn in substantially the same manner.

Nevertheless, whereas each strand of weft yarn is at a single temperature, the strands of warp yarn extend parallel to the travel direction of the fabric through the chamber so they are not at uniform temperature. The temperature of any given strand of warp yarn varies between its portion which is exposed to the lowest temperature prior to the entrance to the chamber, and its portion which is exposed to the highest temperature, at the opposite end of the chamber.

Furthermore, although the weft yarn shrinks practically freely, the warp yarn always shrinks somewhat less than the maximum possible amount because of the tension which is inevitably exerted on the warp yarn by the means for supporting and driving the fabric that is travelling continuously.

The temperature profile of the method of the invention seeks to satisfy a first concern which is to cause the weft yarn to shrink in such a manner as to ensure that the shape of the fabric remains unaltered during shrinkage so as to avoid the fabric becoming disorganized. Thus, in an initial stage after the fabric has entered into the enclosure, temperature rises relatively fast so as to give rise to early shrinkage of the weft yarn.

The temperature profile also seeks to satisfy a second concern, that of obtaining good mechanical quality for the carbon fibers that result from the carbonization. Thus, in an intermediate stage where most of the cellulose decomposition takes place, temperature rises more slowly so as to comply as well as possible with decomposition kinetics. Selecting a mean temperature rise speed lying in the range 2° C./min to 10° C./min makes it possible to satisfy this concern in satisfactory manner without requiring the fabric to follow a path that is of excessive length.

The final stage of carbonization, which seeks essentially to confer the desired structure on the carbon, can again be performed with a faster rate of temperature rise, since nearly all of the warp and weft shrinkage has already taken place, thereby reducing the total duration of carbonization, and thus reducing production costs.

According to a feature of the method, the fabric is caused to travel through the chamber via successive zones, each of which has a controlled temperature therein.

According to another feature of the method, the transit time of the fabric through the chamber lies in the range 20 min to 2 hours (h). Carbonization is thus extremely fast.

According to yet another feature of the method, prior to carbonization, the fabric is subjected to relaxation treatment at a temperature lying in the range 100° C. to 250° C., preferably in air and for a duration that lies in the range 15 min to 3 h, for example.

BRIEF DESCRIPTION OF THE DRAWINGS

Other features and advantages of the invention will appear on reading the following description given by way of non-limiting indication, and made with reference to the accompanying drawings, in which.

DETAILED DESCRIPTION OF IMPLEMENTATIONS OF THE INVENTION

Figure 1:
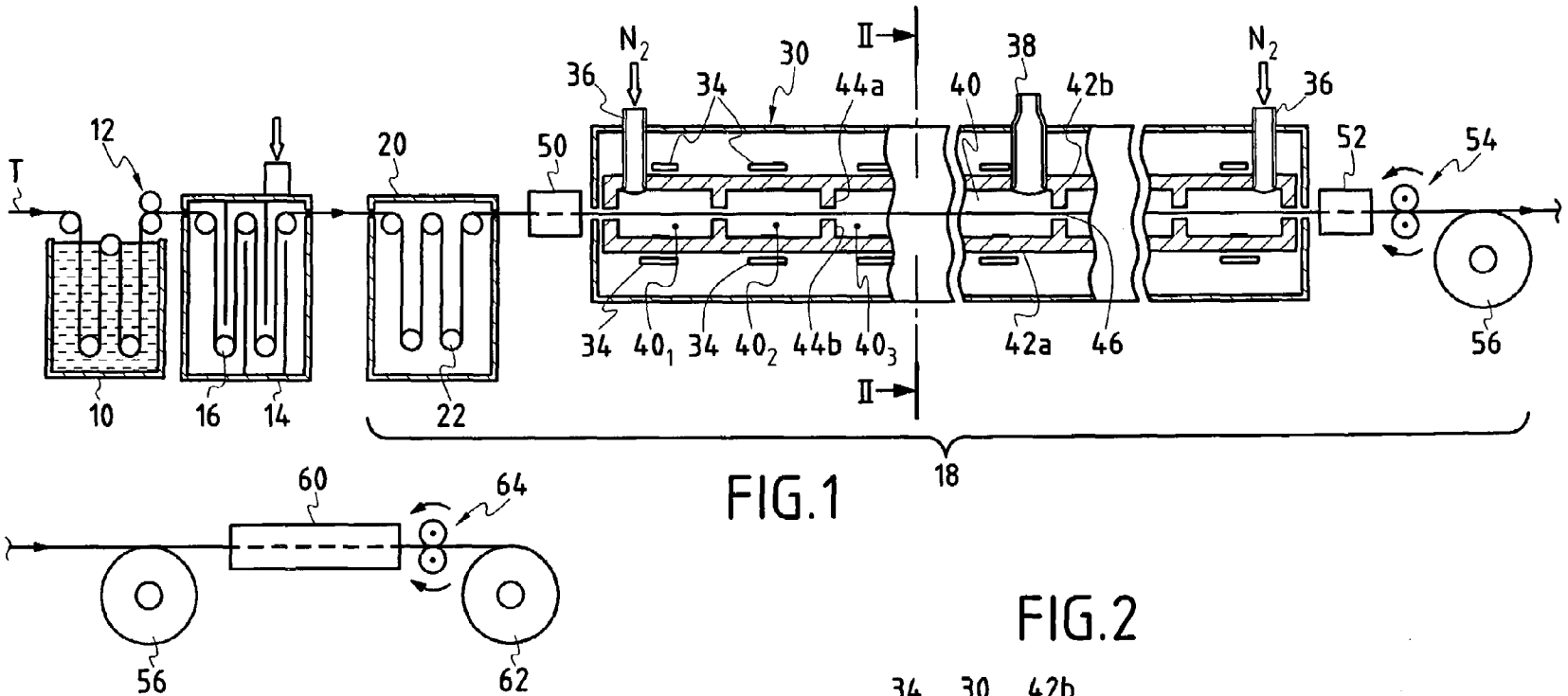
FIG. 1 is a highly diagrammatic longitudinal section view of a continuous carbonization installation for obtaining fabric made of carbon fiber.

An installation for continuously carbonizing cellulose fiber fabric is shown very diagrammatically in FIG. 1.

Carbonization is performed on a cellulose fiber fabric T, e.g. made of engineering viscose fibers, having an organosilicon compound added thereto which acts, during decomposition of the cellulose, to ensure that the resulting carbon fibers retain good mechanical properties.

For this purpose, the viscose fabric T in the dry state and cleaned of any oiling is impregnated by passing through a bath containing said organosilicon compound in solution. As mentioned above, the organosilicon compound can be selected from polysiloxanes. It is preferable to use a polysiloxane selected from the families defined in the International patent applications WO 01/42541 and WO 01/42544, with the content thereof being incorporated herein by reference, said families being:

- the family of cyclic, linear, or branching poly-hydrosiloxanes substituted by methyl and/or phenyl groups, having a number-average molecular mass lying in the range 250 and 10,000, and advantageously in the range 2500 and 5000; and
- the family of cross-linked, cyclic, or branching oligomers and resins presenting a number-average molecular mass lying in the range 500 to 10,000 and constituted by units having the formula $SiO_4$ (referred to as $Q_4$ unit), and units having the formula $SiO_xR_y(OR')_z$ in which:
  - x, y, and z are integers, such that $x+y+z=4$ and $1 \leqq x \leqq 3$; $0 \leqq y \leqq 3$; $0 \leqq z \leqq 3$;
  - R represents hydrogen or a linear or branching alkyl radical having 1 to 10 atoms of carbon, it being possible for there to be different Rs in the same unit when $y \leqq 2$;
  - R' represents, independently of R, hydrogen or a linear or branching alkyl radical having 1 to 10 atoms of carbon, it being possible for there to be different R's in the same unit when $z \leqq 2$;

it being understood that:

- for oligomers presenting a number-average molecular mass less than 1000, $z \neq 0$ in said formula $SiO_xR_y(OR')_z$; and
- for resins having a number-average molecular mass greater than 2000, $y \neq 0$ in said formula $SiO_xR_y(OR')_z$.

In particular, the organosilicon compound can be a siloxane resin, constituted by units having the formula $SiO_4$ (referred to as $Q_4$ units), units having the formula $SiO_3$—OH (referred to as $Q_3$ units), and units having the formula O—Si—$R_3$ (referred to as M units), advantageously constituted by $n_1$ $Q_4$ units, $n_2$ $Q_3$ units, and $n_3$ M units, where $2 \leqq n_1 \leqq 70$, $3 \leqq n_2 \leqq 50$, and $3 \leqq n_3 \leqq 50$, and presenting a number-average molecular mass lying in the range 2500 to 5000.

The organosilicon compound can also be selected from oligomers of a partially hydrolyzed organic silicate, advantageously selected from oligomers of a partially hydrolyzed alkyl silicate, and preferably selected from oligomers of partially hydrolyzed ethyl silicate.

Impregnation is performed by causing the fabric T to pass through a vessel 10 containing the selected organosilicon compound, in solution in a solvent such as a chlorine-containing solvent (e.g. perchloroethylene), or acetone. The fabric can be impregnated by passing through a bath (as shown) and/or by spraying the solution of the organosilicon compound on both faces of the fabric. On leaving the vessel 10, the impregnated fabric is pressed out by passing between rollers 12 so as to leave a controlled quantity of the compound.

The impregnated fabric is then admitted into a dryer 14 so as to eliminate the solvent. Drying is performed, for example, by a flow of hot air flowing in the opposite direction to the fabric passing over variable tensioning rollers 16.

The impregnated and dry fabric is ready for being carbonized. It can be stored temporarily, e.g. placed in superposed layers in a container, or it can be admitted directly and continuously into the carbonization station 18 proper.

It will be observed that the fabric can also be impregnated with at least one inorganic additive, a Lewis base or acid, e.g. selected from halides, sodium or ammonium phosphates and sulfates, urea, and mixtures thereof, and advantageously consist in ammonium chloride ($NH_4Cl$) or diammonium phosphate [$(NH_4)_2HPO_4$].

Carbonization comprises moderate heat treatment for drying and relaxing the fabric followed by passing through an oven where carbonization proper is performed.

The relaxation treatment is performed by admitting the fabric into an enclosure 20 at atmospheric pressure under ambient air. The temperature inside the enclosure 20 is set to a value lying in the range 100° C. to 250° C., e.g. about 130° C. The transit time through the enclosure 20 preferably lies in the range 15 min to 3 h. The length of the path followed by the fabric through the enclosure, passing over deflector rollers 22 is selected so as to obtain the desired transit time as a function of the travel speed of the fabric. The relaxation heat treatment serves to relax internal stresses in the cellulose fibers and to eliminate the water adsorbed by the fabric.

Carbonization is then performed by admitting the fabric into an enclosure 30 that contains a carbonization chamber 40. The cellulose fiber fabric is admitted into the chamber 40 at one end thereof and the carbon fiber fabric is extracted from the chamber 40 at its opposite ends, in both cases through sealing boxes 50, 52. On entering the box 50, the fabric has returned substantially to ambient temperature.

In the example shown, the carbonization chamber is an elongate chamber through which the fabric follows a horizontal rectilinear path. Other carbonization chamber configurations could be envisaged, e.g. a chamber having a plurality of consecutive adjacent portions that are horizontal or vertical with the fabric being guided therein by deflector rollers.

The chamber 40 is defined by top and bottom horizontal walls 42*a* and 42*b*, and by vertical side walls 42*c* and 42*d*, e.g. made of graphite. The chamber 40 is surrounded by an enclosure 30. Electrical heater resistors 34 are located inside the enclosure 30 close to the outside faces of the walls 42*a* and 42*b*.

The inside of the chamber 40 is maintained under an inert atmosphere, e.g. under nitrogen injected via pipes 36 respectively close to the entrance and close to the exit of the chamber. While carbonization is taking place, the products of cellulose decomposition are extracted from the chamber via one or more chimneys 38. The extractor chimneys are placed at locations in the oven where the major part of cellulose decomposition occurs. The extracted products can be burnt off in a flare (not shown).

The sealing boxes 50, 52 prevent ambient air gaining access to the inside of the chamber 40 since that would have the effects of disturbing gas flow inside the chamber 40 and of oxidizing the carbonized fabric. The sealing boxes 50, 52 also prevent polluting leakage of cellulose decomposition products into the building housing the enclosure 30. It is advantageous, at least for the entrance sealing box 50, to use a combination of static sealing by means of an inflatable seal that comes into contact with the fabric with a minimum of friction, and dynamic sealing by means of a barrier formed by injecting inert gas. An embodiment of such a sealing box is described in the International patent application No. WO 01/42544, the content of which is incorporated herein by reference.

Figure 2:
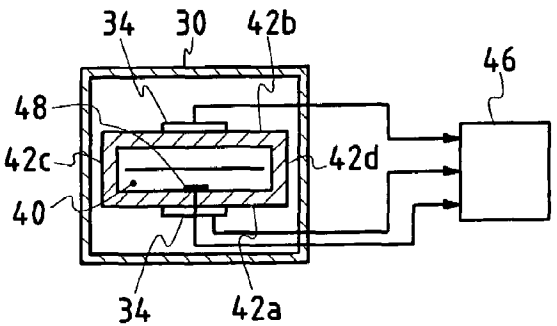
FIG. 2 is a cross-section view on plane II—II of FIG. 1.

In cross-section, the carbonization chamber 40 presents an elongate rectangular profile (FIG. 2). Between the entrance and the exit of the chamber 40, the fabric passes in succession through adjacent zones that are separated from one another by transverse walls 44*a*, 44*b*. By way of example, the walls 44*a* are made of graphite and are connected to the top and side walls of the chamber 40, while the walls 44*b* are likewise made of graphite, for example, and are connected to the bottom and side walls of the chamber 40. The facing ends of the walls 44*a* and 44*b* leave slots 46 between them through which the fabric passes.

By subdividing the chamber 40 into a plurality of consecutive zones $\mathbf{40}_1$, $\mathbf{40}_2$, $\mathbf{40}_3$, . . . , it is possible to define different temperature zones between the entrance and the exit of the chamber 40. In each zone, temperature is regulated on a predetermined reference value. For this purpose, the electrical currents passing through the resistors 34 are regulated by a control circuit 46 on the basis of information supplied by temperature probes 48 located in the various zones $\mathbf{40}_1$, $\mathbf{40}_2$, $\mathbf{40}_3$, . . . .

In the invention, the temperatures in the various zones of the carbonization chamber are determined as is the fabric travel speed which is a function of the length of said zones, in such a manner that the heat treatment applied to the fabric comprises:

- an initial stage during which the temperature of the fabric is raised to a value lying in the range 250° C. to 350° C., with the temperature of the fabric rising at a first mean speed lying in the range 10° C./min to 60° C./min;
- an intermediate stage during which the temperature of the fabric is brought to a value lying in the range 350° C. to 500° C., with the temperature of the fabric rising at a second mean speed that is lower than the first, and lies in the range 2° C./min to 10° C./min; and
- a final stage during which the temperature of the fabric is brought to a value lying in the range 500° C. to 750° C., the final stage including a temperature rise at a third mean speed greater than the second mean speed and lying in the range 5° C./min to 40° C./min.

Figure 3:
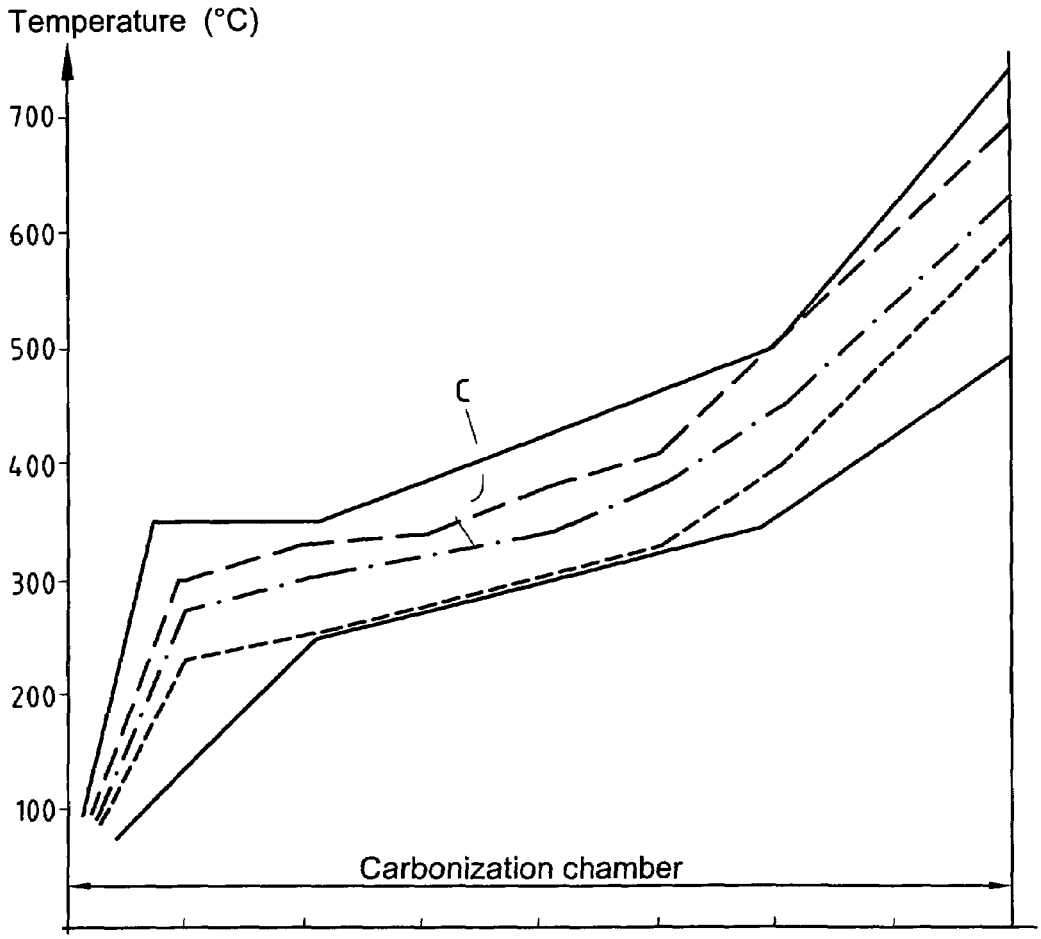
FIG. 3 shows upper and lower limits for the temperature profile of fabric inside a carbonization chamber in a method of the invention.

The upper and lower limits corresponding to the temperature profile for the fabric are shown in FIG. 3 by continuous lines. In FIG. 3, the chain-dotted line C illustrates a "typical" profile.

The initial stage seeks to impose early shrinkage of the weft of the fabric so that it adapts to the configuration of the warp yarn. While each strand of weft yarn heats progressively on entering the carbonization chamber, the fraction of each strand of warp yarn that is penetrating into the chamber is influenced by the fraction which is situated downstream and is exposed to a much higher temperature. By imposing a fast temperature rise on entry into the chamber 40, the weft can "follow" the shrinkage of the fabric and avoid shape defects appearing in the fabric.

That is why a relatively fast temperature rise speed is selected. On average it lies in the range 10° C./min to 60° C./min, and preferably in the range 10° C./min to 40° C./min. The speed of temperature rise can be higher at the beginning of the initial stage than at the end thereof.

The temperature of the fabric at the end of the initial stage lies in the range 250° C. to 350° C., and preferably in the range 270° C. to 300° C.

The intermediate stage is the stage during which most of the cellulose decomposition takes place. In order to conserve good mechanical behavior for the fibers, this decomposition must be controlled, i.e. it must take place with temperature rising at a moderate speed. On average, this speed lies in the range 2° C./min to 10° C./min, and preferably in the range 4° C./min to 6° C./min, it being understood that too slow a speed would be penalizing, economically speaking.

The temperature of the fabric at the end of the intermediate stage lies in the range 400° C. to 450° C. This temperature is the temperature at which most of the cellulose decomposition takes place.

The final stage is the stage in which the carbonization of the fibers is finished off so as to obtain the desired carbon structure.

The temperature of the fabric at the end of the final stage lies in the range 500° C. to 750° C., e.g. in the range 550° C. to 650° C. in order to obtain a sufficiently high degree of carbonization.

During the final stage, temperature rise can take place faster than during the intermediate stage, since the major part of cellulose decomposition has already taken place. In addition, the constraints associated with differential shrinkage between the warp and weft yarns are smaller since most of the shrinkage has already taken place both in the warp direction and in the weft direction. The mean speed of temperature rise is selected to lie in the range 5° C./min to 40° C./min, e.g. in the range 25° C./min to 30° C./min.

The accuracy with which the temperature profile desired for the fabric in the carbonization chamber 40 can be reproduced increases with an increasing number of zones within the chamber, with temperature being controlled individually in each zone. In practice, the minimum number of zones is equal to 3, and is preferably not less than 6.

On leaving the sealing box 52, the fabric passes between pull rollers 54 prior to being stored, e.g. in the form of a roll 56. The pull rollers are associated with drive means (not shown) for causing the fabric to travel at the desired speed. It will be observed that because the warp yarn shrinks during carbonization, the speed of the fabric on entry into the chamber 40 is greater than its speed on exit therefrom.

The transit time of the fabric through the chamber 40 lies in the range 20 min to 2 h.

High temperature heat treatment can be performed on the carbonized fabric coming from the chamber 40. This heat treatment is performed continuously by passing the fabric through an oven 60. This heat treatment seeks to structure the carbon fibers. It is performed at a temperature greater than 1000° C., possibly as high as 2800° C., in an inert atmosphere, e.g. nitrogen. The transit time of the fabric through the oven 60 preferably lies in the range 1 min to 10 min e.g. being about 2 min. The fabric is taken from the roll 56, and on leaving the oven 60 it is stored on a roll 62, being driven by rollers 64.

The carbon fabric coming directly from the chamber 40 can also be oxidized in controlled manner by exposing it to steam or to carbon dioxide, under well-known conditions for obtaining activated carbon fabric, without using high temperature heat treatment.

EXAMPLE 1

A carbonization installation was used having a chamber subdivided into eight zones $\mathbf{40}_1$ to $\mathbf{40}_8$ all of equal length.

Various strips of the same engineering rayon fabric made using 3600 dtex yarn with warp and weft counts of 11 strands per cm were carbonized in said installation after being subjected to impregnation by an organosilicon compound constituted by a polyhydromethyl-siloxane resin sold by the French company, Rhodia Silicones, under the reference RHODORSIL RTV 141 B, and drying and relaxation treatment at 170° C. for 90 min.

The various regulated temperatures in the zones of the oven and the various travel speeds were selected so that the temperatures and temperature rise speeds of the fabric in the various zones of the carbonization chamber 40 lay within the range given in the table below. The temperature limits are drawn as dashed-line curves in FIG. 3. The total times required for carbonization lay in the range 30 min to 70 min.

| Zone | $40_1$ | $40_2$ | $40_3$ | $40_4$ | $40_5$ | $40_6$ | $40_7$ | $40_8$ |
|---|---|---|---|---|---|---|---|---|
| Temp. (° C.) | 230 to 300 | 250 to 330 | 270 to 340 | 300 to 360 | 330 to 410 | 400 to 510 | 510 to 600 | 600 to 700 |
| Mean rate of temperature rise (° C./min) | 20 to 60 | 2 to 10 | 2 to 10 | 2 to 10 | 2 to 10 | 5 to 25 | 5 to 25 | 5 to 25 |

In this oven, the chimney(s) for evacuating cellulose decomposition products are situated between zones $\mathbf{40}_5$ and $\mathbf{40}_6$.

In all cases, by using the temperature profile of the invention, it was found that the fabric leaving the carbonization chamber was free from any creasing.

After carbonization, the fabric was subjected to continuous treatment at 1200° C. under nitrogen for 90 seconds (s).

Traction tests were performed on the various strips of carbon fabric that were obtained. Values in the range 30 decaNewtons per centimeter (daN/cm) to 70 daN/cm were measured in the warp direction and in the range 30 daN/cm to 50 daN/cm in the weft direction for fabric weighing 310 grams per square meter (g/m$^2$) to 330 g/m$^2$. At carbon filament level, that corresponds to breaking strength lying in the range 1000 megapascals (MPa) to 1300 MPa and to a Young's modulus lying in the range 30 gigaPascals (GPa) to 50 GPa.

COMPARATIVE EXAMPLE

A rayon fiber fabric of the kind used in the above examples was carbonized continuously.

By way of comparison, the same fabric was carbonized under similar conditions, but with the exception of the carbonization profile, where the temperature of the fabric was caused to rise at a constant speed of 7° C./min from ambient temperature to 650° C.

Figure 4:
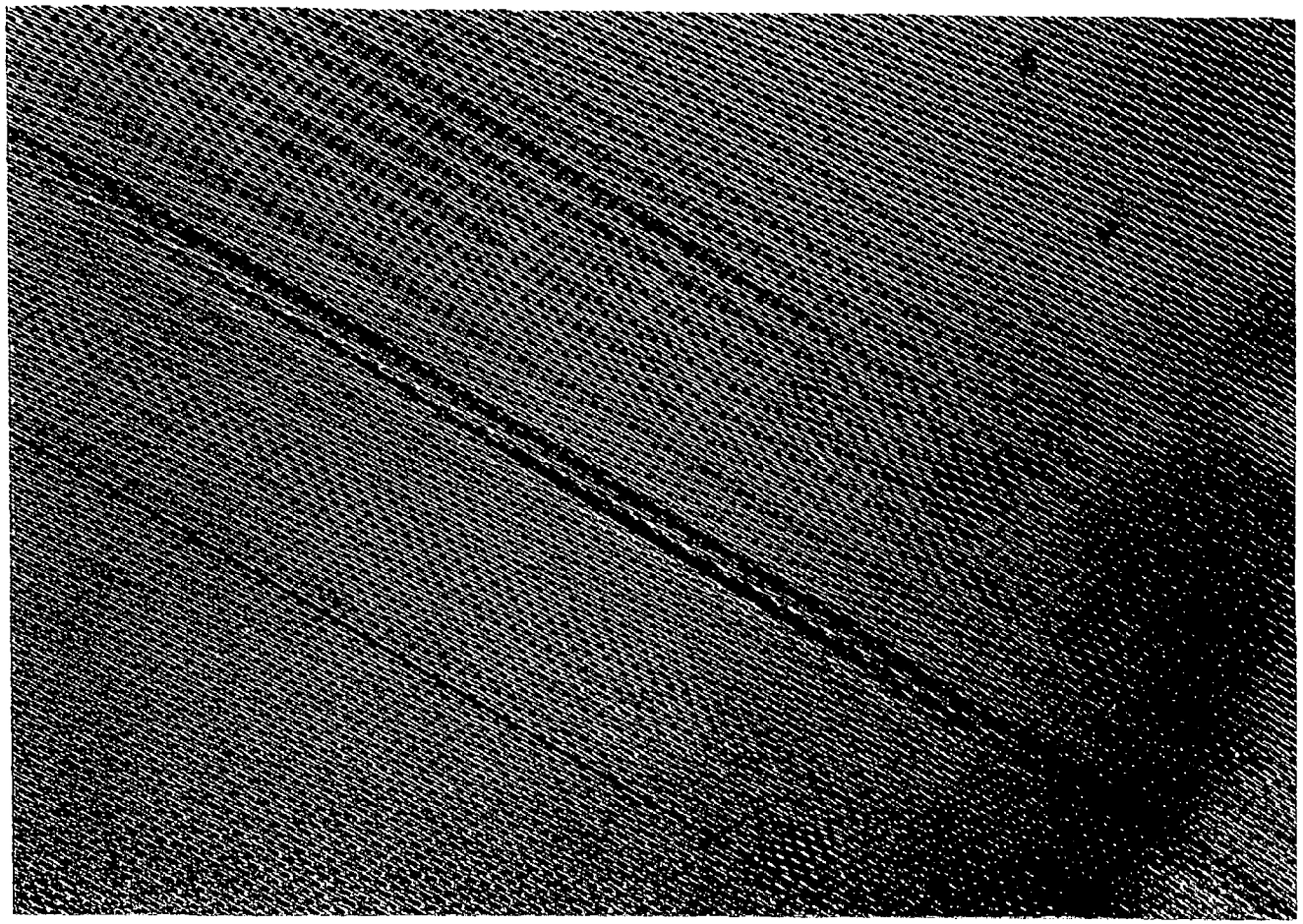
FIG. 4 shows the fabric obtained by implementing a method other than the method of the invention.

FIG. 4 shows the creased appearance of the resulting fabric, due to differential shrinkage in the warp and weft directions.

What is claimed is:

1. A method of obtaining a carbon fiber fabric by carbonizing a cellulose fiber fabric, the method comprising:

(a) admitting a cellulose fiber fabric having warp and weft yarns to be carbonized through an inlet to a carbonization chamber;

(b) causing the cellulose fiber fabric to be subjected to a heat treatment by travelling continuously through the carbonization chamber between said inlet and an outlet of the carbonization chamber, wherein a method of said heat treatment comprises:

(i) entering an initial chamber stage at said inlet of the carbonization chamber for bringing the temperature of the cellulose fiber fabric entering the carbonization chamber to a value lying in the range 250° C. to 350° C., the initial stage comprising temperature rise at a first mean speed lying in the range 10° C./min to 60° C./min;

(ii) exiting the initial chamber stage and entering an intermediate stage for raising the temperature of the fabric to a value lying in the range 350° C. to 500° C., the intermediate stage comprising temperature rising at a second mean speed lower than the first and lying in the range 2° C./min to 10° C./min; and (iii) departing the intermediate chamber stage and entering a final stage for raising the temperature of the fabric to a value lying in the range 500° C. to 750° C., the final stage comprising temperature rising at a third mean speed greater than the second and lying in the range 5° C./min to 40° C./min; and (c) retrieving a carbon fiber fabric resulting from carbonization of said cellulose fiber fabric at the outlet of the carbonization chamber.

2. A method according to claim 1, characterized in that the transit time of the fabric through the chamber lies in the range 20 min to 2 h.

3. A method according to claim 1, characterized in that, prior to carbonization, the fabric is subjected to relaxation treatment at a temperature lying in the range 100° C. to 250° C.

4. A method according to claim 3, characterized in that the relaxation treatment is performed in air.

5. A method according to claim 3, characterized in that the relaxation treatment is performed for a duration lying in the range 15 min to 3 h.

6. A method according to claim 1, characterized in that the carbonized fabric is subjected to high temperature heat treatment lying in the range 1000° C. to 2800° C. after it has passed through the carbonization chamber.

7. A method according to claim 6, characterized in that the high temperature heat treatment is performed for a duration lying in the range 1 min to 10 min.

8. A method according to claim 1, characterized in that the carbonized fabric is subjected to activation treatment.

9. A method according to claim 4, characterized in that the relaxation treatment is performed for a duration lying in the range 15 min to 3 h.

* * * * *